United States Patent [19]

Sunderland

[11] Patent Number: 4,970,815

[45] Date of Patent: Nov. 20, 1990

[54] LIGHT DISPLAY

[76] Inventor: Howard F. Sunderland, 3939 Allin, Long Beach, Calif. 90803

[21] Appl. No.: 164,573

[22] Filed: Mar. 7, 1988

[51] Int. Cl.[5] ..... G09F 13/18

[52] U.S. Cl. ..... 40/546; 40/473; 368/240; 368/79

[58] Field of Search ..... 40/546, 547, 427, 429, 40/430, 431, 435, 442, 470, 473, 474; 368/240, 79, 76, 74, 82, 84, 227, 239; 362/311, 32

[56] References Cited

U.S. PATENT DOCUMENTS

| | | | |
|---|---|---|---|
| 2,402,014 | 6/1946 | Boeck | 368/240 |
| 2,722,762 | 11/1955 | Krajian | 40/546 |
| 2,766,447 | 10/1956 | Woodson, Jr. et al. | 40/546 |
| 3,040,168 | 6/1962 | Stearns | 40/546 |
| 3,257,748 | 6/1966 | Hardesty | 40/546 |
| 3,332,161 | 7/1967 | Hardesty | 40/546 |
| 3,384,986 | 5/1968 | Davis | 40/546 |
| 3,399,476 | 9/1968 | Davis | 40/473 |
| 3,464,133 | 9/1969 | De Poray | 40/546 |
| 3,651,634 | 3/1972 | Cooper | 368/79 |
| 4,279,089 | 7/1981 | Murakami | 40/547 |
| 4,630,177 | 12/1986 | Von Kohorn et al. | 362/311 |

FOREIGN PATENT DOCUMENTS

| | | | |
|---|---|---|---|
| 16366 | 2/1903 | Sweden | 40/546 |
| 99672 | 8/1940 | Sweden | 40/546 |
| 847972 | 9/1960 | United Kingdom | 40/546 |

*Primary Examiner*—Kenneth J. Dorner
*Assistant Examiner*—J. Hakomaki
*Attorney, Agent, or Firm*—Timothy T. Tyson

[57] ABSTRACT

A light computer is provided for illuminated and animated displays. Light planes are illuminated and images carried thereon are lit when light is applied to any edge. A moving light and opaque coatings on the edges of the light plane are used to vary the sequence and time the frequency and duration of the lighting of the plane. When an opaque coating is positioned between the light and the plane, the plane does not light. Only when the opaque coating is not present and the light is present is the plane lit. In a preferred embodiment, the light source is mounted at the end of a stack of circular light planes and light from the light source is admitted to the edges of the light planes by means of a rotating mask having a window leading to a prism for reflecting the light onto the edges.

10 Claims, 1 Drawing Sheet

LIGHT DISPLAY

TECHNICAL FIELD

The present invention pertains to the light display art, and more particularly, to a stack of light planes selectively lit by a uniformly moving light and mask operating in conjunction with edge masking or coloring on the planes and method of use.

BACKGROUND ART

Stacks of light planes have long been used to create moving or selectable static displays for object animation or information transmission. For example, a running greyhound dog is shown in U.S. Pat. No. 1,930,359. Two light planes are used with the dog represented on one plane in a first running position and on the second plane in a second running position. One light on the edge of the first plane selectively lights the first plane while a second light on the edge of the second plane selectively lights the second plane. The lights are alternately lit creating the effect of a running dog. Other two plane systems are shown in U.S. Pat. Nos. 2,623,313 and 2,948,580.

Ten light plane stacks for selectively displaying the digits from 1 to 0 are shown in U.S. Pat. Nos. 2,751,584; 2,766,447; and 2,813,266. A light is provided adjacent each plane for lighting that plane. All of the above devices use electrical switching to achieve the desired movement or selection.

Other systems use moving mechanical components including lights, mirrors, or masks. A multi-colored rotating bulb is shown in U.S. Pat. No. 2,524,657 for continuously changing the colors of letters in three light planes. All of the planes in this device are lighted continuously. A rotating mirror is shown in U.S. Pat. No. 3,273,274 for reflecting light from a bulb into ten light planes one at a time in a continuous sequence. Rotating masks between the light source and the light planes are shown in U.S. Pat. Nos. 2,722,762; 2,994,971; and 4,244,130. Light shines into a particular light plane only when a window in the mask is present between the light source and the light plane. Of these, the first and last have masks that are rotated continuously by motors. The second has a mask that is adjusted by hand to selectively illuminate one of a plurality of planes.

Motor driven rotating lights, mirrors, and masks are therefore known to be useful in the sequential lighting of a stack of light planes. However, these prior art devices are limited to this sequential lighting of adjacent light planes. The simultaneous lighting of two or more non-adjacent planes or variations in the lighting sequence or plane combinations in the same revolution are beyond the capabilities of these devices.

DISCLOSURE OF INVENTION

The present invention is directed to a light computer and method for illuminated and animated displays where the illumination is not restricted to the sequential lighting of adjacent light planes but is limited only by the imagination of the designer. A light plane will illuminate the images carried thereon when light is applied to any edge because light inside the light plane bounces around inside the plane. The present invention relies upon this principle. Where an opaque means is positioned between the light and the edge of the plane and the light is moved along the edge. The images on the plane are not lit when the opaque means is between the light and the edge of the plane but are lit when the light moves past the opaque means.

In accordance with one important aspect of the invention, a plurality of stacked light planes are provided.

In accordance with another important aspect of the invention, the light plane is circular and the means for moving the light means with respect to the light plane includes providing a stationary light source and a rotating mask having at least one window. The light plane has a first diameter while the rotating mask has a second diameter. The window is positioned in the rotating mask outside of the first diameter. A light reflective means is positioned outside the first diameter for reflecting light from the light onto the edge. Light falls on the edge where the window is between the light and the edge and does not fall on the edge where the window is not between the light source and the edge. In a preferred embodiment, the light reflective means is a circular segmented prism.

In accordance with another important aspect of the invention, the means for moving the light with respect to the plane includes a rotating tubular light source positioned along the edge having a mask with a spiral window. The light then falls on the edge where the spiral window is between the light and the edge and does not fall on the edge where the spiral window is not between the light and the edge. In a preferred embodiment, light shields are provided between the light and the edge for restricting transmission of light along the edge.

Other features and advantages of the present invention will become apparent from the following detailed description, taken in conjunction with the accompanying drawings, which illustrate, by way of example, the principles of the invention.

MODES FOR CARRYING OUT THE INVENTION

Figure 1:
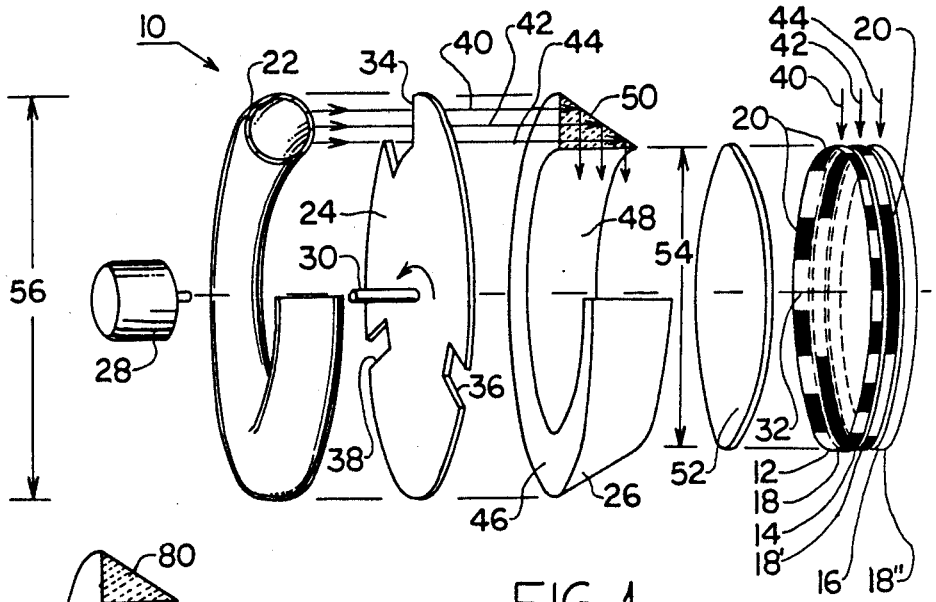
FIG. 1 is a rear and side exploded perspective view of a light computer for illuminated and animated displays in accordance with the present invention.

Referring initially to FIG. 1, there is illustrated a rear and side exploded perspective view of a light computer for illuminated and animated displays, generally designated 10, of the present invention. Three stacked circular light planes 12, 14, and 16 are shown in the preferred embodiment for purposes of illustration. However, it will be appreciated that any number of light planes may be used ranging from one to ten or more depending upon the object to be animated or selection of static elements to be displayed. The viewer is positioned to the right of the computer 10 and looks into the stack of light planes. Any letters or designs printed on or embedded into a light plane will be visible to the viewer if light is applied to the edge 18, 18', 18'' of that plane. If light is not transmitted into the particular plane, the plane is not lit and the letters or designs are not visible.

The circular construction of each light plane allows the plane to be lighted equally well from any angle.

Arrayed around the edges 18, 18', and 18" are opaque coatings 20 which prevent light from entering a plane through a coating. Thus, a light may be presented to an edge but not be able to light the plane 12, 14, or 16 because of an opaque coating. Where the light is present and the opaque coating is not between the light and the light plane, the light plane is lighted. Where the light is present and the opaque coating is between the light and the light plane, the light plane is not lighted.

In order to take advantage of the timing possibilities provided by the opaque coatings, the light means is moved around the edges. In the preferred embodiment, the light means is provided by a light source 22 in the form of a circular fluorescent tube operating in conjunction with a moving circular rotating mask 24, and a light reflective means in the form of a prism 26. Portions of both the light source 22 and the prism 26 are omitted in order to allow sections thereof to be shown. An electric motor 28 provides a means for rotating the rotating mask 24 on an axle 30 aligned with the axis 32 of the circular light planes 12, 14, and 16. Windows 34, 36, and 38 through the rotating mask 24 allow light from the light source 22 to pass through the mask as represented by the arrows 40, 42, and 44. Light represented by the arrow 40 reflects off the prism 26 into the left light plane 12. Light represented by the arrow 42 enters the middle plane 14, and light represent by the arrow 44 enters the right plane 16. The light enters the prism 26 through a light face 46 nominal to the light source 22. It exits the prism through an edge face 48 nominal to the edges 18, 18', and 18". The light is reflected off a hypotenuse face 50 of the prism which may have a reflective coating on the outside. The body of the rotating mask 24 itself and a light shield 52 prevent light from the light source 22 from entering the light planes in any other manner. The light planes have a first diameter 54. The rotating mask has a second diameter 56 larger than the first diameter. The windows 34, 36, and 38 are positioned in the rotating mask outside of the first diameter 54.

Whether a plane is lighted or not is dependent upon two factors: whether light is presented at the edge thereof and whether or not an opaque means is present to block the light. The light is available every time a window is present between the light source and the light plane. If the motor turns the rotating mask at a uniform rate, the light is present at any given location on the edge of a light plane at precise intervals. These intervals are dependent upon the speed of rotation of the rotating mask and the number of windows. Three windows are shown in the preferred embodiment. The windows are arrayed at 120° from each other in order to optimally light the information on the light planes. (It will be appreciated that the same frequency and duration of light transmission through the mask could be obtained by providing the mask with one window three times as wide as the present windows and rotating the mask three times as fast.) Whether the light is used or not and for how long it is used is determined by the opaque coatings on the edges of the light planes. The opaque coatings thus serve as gates for introduction of the light into the light planes. For example, if no opaque coatings are present at all on the edge of a light plane as is the case with plane 16, the plane will always be lit. If opaque coatings are present on alternate sixths of the circumference of the light plane as is the case with plane 14, the plane will be lit half of the time. If opaque coatings are present on alternate twelfths of the circumference of the light plane as is the case with plane 12, the plane will again be lit half of the time but at twice the frequency and for half of the duration of the lighting of plane 14.

Figure 2:
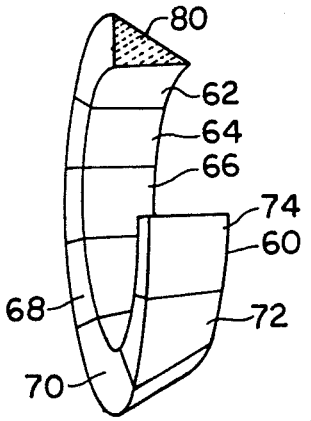
FIG. 2 is a rear and side perspective view of a segmented prism.

FIG. 2 is a rear and side perspective view of a segmented prism 60 similar to the prism 26 shown in FIG. 1. As in FIG. 1, a portion of the prism 60 is omitted in order to show a cross section. The fabrication of the prism 60 by the assembly of segments 62 to 74 provides barriers to the transmission of light around the prism in the form of the ends of the segments such as the end 80 of the segment 62 that reflect light back into the segment from which it originates stopping light from bouncing around the prism to areas away from the windows 34, 36, and 38 where it is not wanted. The ends of the segments are cut substantially perpendicular to the faces of the prism.

Figure 3:
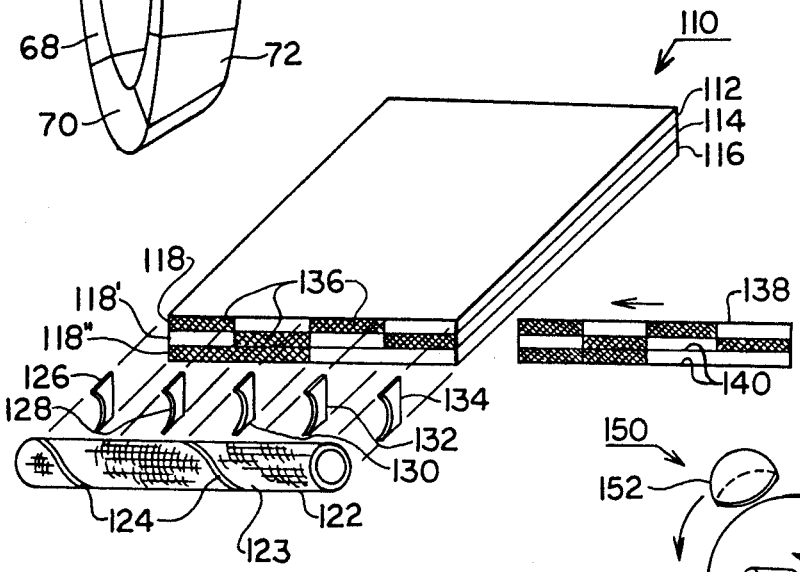
FIG. 3 is a front and top exploded perspective view o embodiment.

FIG. 3 is a front and top exploded perspective view of a second embodiment of the light computer, generally designated 110. The light planes 112, 114, and 116 have front edges 118, 118', and 118" in the same plane. A rotating tubular light source 122 is positioned along the edges. The light source has a mask 123 thereon that blocks all light except for light that is able to exit through a spiral window 124. Light from the light source 122 falls on the edges 118, 118', and 118" where the spiral window 124 is between the light source and the edges and does not fall on the edges where the spiral window is not between the light source and the edges. Several light shields 126, 128, 130, 132, and 134 are provided between the light source and the edges of the light planes for restricting the transmission of light along the edges where it may not be wanted.

The light computer 110 shown in FIG. 3 operates in the same manner as the light computer 10 in FIG. 1. Opaque means in the form of opaque coatings 136 or an edge mask 138 having windows 140 are positioned between the light and the edges of the light planes. Light is able to enter a light plane only when the spiral window and no opaque means are present between the light source and the light plane edge. If either is present, the plane will not be lit.

Figure 4:
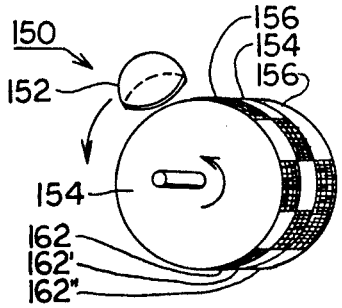
FIG. 4 is a front and side perspective view of a third embodiment.

FIG. 4 is a front and side perspective view of a third embodiment of the light computer, generally designated 150. In this embodiment, either the light source 152 rotates about the stack 154 of light planes 156, 158, and 160 or the stack of light planes rotates in front of light source. No rotating mask is present as in the previous embodiments nor is needed because the light source is perpendicular to the edges 162, 162', and 162" of the light planes and covers only a limited arc of the light planes.

Other variations are possible in all of the above embodiments by providing means for coloring a light plane such as a colored film or coating along all or portions of an edge in the same manner as provided by the opaque means. Then, instead of blocking all light from entering the light plane, the colored film or coating colors the light plane for the time period desired.

In view of the above, it may be seen that several variations of the light computer are provided which may be used to illuminate one or a plurality of light planes in an unlimited number of variations. Of course, the structure may be variously implemented depending upon specific applications. Accordingly, the scope hereof shall not be referenced to the disclosed embodiments, but on the contrary, shall be determined in accordance with the claims as set forth below.

I claim:

1. A light display comprising:

at least two light planes of transparent, light transmitting material, each having an edge and substantially parallel faces for reflecting light that has entered the edge;

a light means for providing light to said edges;

opaque means permanently covering portions of said edges for stopping light from said light means from entering said light planes when said opaque means are between said edge and said light means; and means for continuously moving the light provided by said light means along said edges.

2. A light display according to claim 1 wherein said at least two light planes are circular having a first diameter and an axis and said means for continuously moving the light provided by said light means along said edges includes;

a stationary light source;

a circular rotatable mask having at least one window;

said rotatable mask rotatable on an axle aligned with said axis;

a means for rotating said rotatable mask;

said rotatable mask having a second diameter larger than said first diameter;

said at least one window positioned in said rotatable mask outside of said first diameter; and a light reflective means outside said first diameter for reflecting light from said light source onto said edges.

3. A light display according to claim 2 wherein said opaque means is an opaque coating.

4. A light display according to claim 2 wherein said opaque means is an edge mask having at least one window.

5. A light display according to claim 2 wherein said light reflective means is a circular prism having a light face nominal to said light source, an edge face nominal to said edge and perpendicular to said light face, and a hypotenuse face.

6. A light display according to claim 5 wherein said circular prism includes a plurality of segments cut substantially perpendicular to said light, edge, and hypotenuse faces for restricting transmission of light around said prism.

7. A light display according to claim 1 wherein said means for continuously moving the light provided by said light means along said edges includes:

a rotating tubular light source positioned along said edges;

said light source having a mask thereon and rotating therewith; and, said mask having a spiral window;

whereby light from said light source falls on said edges where said spiral window is between said light source and said edges and does not fall on said edges where said spiral window is not between said light source and said edges.

8. A light display according to claim 7 and further comprising a plurality of light shields between said light source and said edges for restricting transmission of light along said edges.

9. A light display according to claim 8 wherein said opaque means is an opaque coating.

10. A light display according to claim 8 wherein said opaque means is an edge mask having at least one window.

* * * * *